United States Patent [19]

Nomura et al.

[11] Patent Number: 4,869,512

[45] Date of Patent: Sep. 26, 1989

[54] GOLF BALL

[75] Inventors: June Nomura, Yokohama; Keisuke Ihara, Tokyo, both of Japan

[73] Assignee: Bridgestone Corporation, Tokyo, Japan

[21] Appl. No.: 123,103

[22] Filed: Nov. 19, 1987

[30] Foreign Application Priority Data

Nov. 19, 1986 [JP] Japan ..... 61-276199
Feb. 16, 1987 [JP] Japan ..... 62-31611

[51] Int. Cl.[4] ..... A63B 37/14
[52] U.S. Cl. ..... 273/232; 273/213
[58] Field of Search ..... 273/232, 233, 235 R, 273/183 C, 213; 40/327

[56] References Cited

U.S. PATENT DOCUMENTS 2,728,576 12/1955 Martin et al. ..... 273/232
4,284,276 8/1981 Worst ..... 273/232

FOREIGN PATENT DOCUMENTS 48-19325 3/1973 Japan ..... 273/232
16862 of 1890 United Kingdom ..... 273/232
189551 12/1922 United Kingdom ..... 273/232
377354 7/1932 United Kingdom ..... 273/232

*Primary Examiner*—George J. Marlo
*Attorney, Agent, or Firm*—Birch, Stewart, Kolasch & Birch

[57] ABSTRACT

A golf ball having dimples formed in its spherical surface having improved flying performance when at least 7% of the total dimples are non-circular in shape, and the total of the surface area occupied by all the dimples is at least 65% of the spherical surface area of the golf ball.

6 Claims, 13 Drawing Sheets

GOLF BALL

BACKGROUND OF THE INVENTION

This invention relates to a golf ball having dimples uniformly distributed on its spherical surface and exhibiting improved and stabilized flying performance.

Golf balls having dimples distributed on its spherical surface are well known in the art. The pattern of dimple distribution on a golf ball is generally based on dimples which are circular in plane view as seen from the typical patterns shown in FIGS. 18 and 19. The design policy taken in distributing circular dimples on a spherical surface is that they are distributed as uniformly as possible, that is, the distance between adjoining dimples is as equal as possible over the entire spherical surface. This is because it is commonly believed desirable that the entire spherical surface is aerodynamically uniform. A number of proposals have been made on the basis of this concept.

Dimpled golf balls are usually prepared using a pair of mold halves which can be vertically or laterally separated. Then, an annular land where no dimples are present, known as a parting line, is formed on a golf ball at a location corresponding to the mating edges of the mold halves to be separated.

The distribution and dimensions of dimples on a spherical surface are generally designed by starting with a regular polyhedron including regular tetrahedron to regular eicosahedron, and determining the position and configuration of dimples on each surface of the polyhedron, that is, on a plane, and then projecting the determined planar dimple on a spherical surface inscribing or circumscribing the regular polyhedron. Then dimples of certain dimensions are properly distributed on a spherical surface.

A determination of the position and configuration of dimples on each surface of a regular polyhedron will be described by taking as an example a regular octahedron as shown in the perspective view of FIG. 20*a*. The regular octahedron is constituted by eight (8) regular triangles as shown in FIG. 20*b*. Determination is made by first taking a regular triangle defining one surface of the hedron as a unit, determining the position and configuration of dimples such that planar dimples are fully uniformly distributed over the entire area of the triangle, and applying the determined position and configuration of dimples to the remaining surfaces. This eicosahedron as shown in FIG. 21*a* is a basic structure. In this case, the position and configuration of dimples are determined with respect to a regular triangle as shown in FIG. 21*b*.

A determination of the position and configuration of dimples on a unit regular triangle may be carried out typically by dividing the unit regular triangle into six congruent triangles, taking as a standard unit one triangle, for example, the shaded triangle in FIG. 20*b* or 21*b*, arranging a group of planar dimples thereon, and forming the same group of planar dimples on the remaining congruent triangles.

In order that a parting line be formed which is extended along a great circle extending on the spherical surface, the unit regular triangle, and hence the standard unit, must be provided with at least one strip-like land which contributes to formation of the parting line, in other words, at least one linear portion that does not intersect the planar dimples. For this reason, strip-like lands as typically shown by thick solid lines in FIGS. 20*c*, 20*d*, and 20*e* must be provided when the regular polyhedron is a regular octahedron, or strip-like lands as typically shown by thick solid lines in FIGS. 21*c*, 21*d*, and 21*e* must be provided when the regular polyhedron is a regular eicosahedron. As shown in the figures, only those dimples having a circular plane shape are distributed within the standard unit where they do not intersect the strip-like lands.

When a regular hexahedron or cube is chosen as a basic structure, the location of a strip-like land and hence, the location of dimples with respect to the standard unit is the same as in the case of a regular octahedron because the hexahedron is in dual; relation to the octahedron. When a regular dodecahedron is chosen as a basic structure, the same procedure as in a regular eicosahedron applies.

As described above, the prior art design requires that only circular dimples are distributed within a standard unit. If the dimples are enlarged to dimensions of about 2 to 5 mm in diameter (3.14 $mm^2$ to 19.6 $mm^2$) capable of substantial contribution to an improvement in aerodynamic properties, then a relatively large spacial area is left between mutually adjoining circular dimples within the standard unit. Then when all such circular dimples are projected on the spherical surface, it is difficult to distribute all the dimples uniformly over the spherical surface. The resulting ball does not exhibit a fully improved or perpetually stabilized flying performance. The problem becomes particularly serious where one standard unit contains more than one strip-like land that cannot be located to intersect circular dimples.

In the area within the standard unit where no strip-like land is present, the degree of freedom of changing the location and dimensions of circular dimples is relatively high so that the dimples can be located in a relatively high density. In the area where strip-like lands are present, however, the prohibition that circular dimples should not intersect the lands reduces the degree of freedom of changing the location and dimensions of circular dimples. It is also difficult to locate circular dimples of the diameter capable of exerting their own function in proximity to the strip-like land, and thus a land of a relatively large area remains in such a region. Particularly in the presence of more than one strip-like land within a standard unit, when every standard unit is projected on a spherical surface, a land of a large area is formed at the opposite sides of each land on the spherical surface corresponding to the strip-like land as well as about the intersection of lands on the spherical surface.

SUMMARY OF THE INVENTION

An object of the present invention is to provide a golf ball having dimples uniformly and densely distributed over its spherical surface and exhibiting improved and stabilized flying performance.

The present invention is directed to a golf ball having a plurality of dimples formed in its spherical surface. According to the feature of the present invention, at least 7% in number of the dimples are non-circular in plane shape and the total of the areas of the dimples in plane shape is at least 65% of the surface area of a phantom sphere having the same diameter as the dimpled golf ball.

Since at least 7% in number of the dimples are non-circular according to the feature of the present golf ball, it is possible to locate non-circular dimples alone or in an admixture with circular dimples within a standard or in a unit so that the dimples may be evenly and densely distributed on the spherical surface. Even distribution of dimples ensures a golf ball having improved flying performance. Dense distribution of dimples over the spherical surface results in an increased proportion of the area that dimples occupy on the golf ball surface, which not only improves the flying performance, but also minimizes a variation in flying performance to provide a consistent flying performance. A reduced area of lands lowers the rigidity of those portions of a golf ball cover layer corresponding to the lands, mitigating the shock at the moment of an impact.

BRIEF DESCRIPTION OF THE DRAWINGS

The above and other objects, features, and advantages of the present invention will be better understood by reading the following description taken in conjunction with the accompanying drawings, in which.

DETAILED DESCRIPTION OF THE INVENTION

The golf ball of the present invention having a plurality of dimples formed in its spherical surface has the feature that at least 7% in number of the dimples are non-circular in plane shape.

The non-circular or profiled plane shapes of dimples used herein may include petal, triangular, oblong shapes, and partially overlapped circles or oblongs, but are not limited to them. Exemplary non-circular plane shapes are shown in FIGS. 1 through 8.

Figure 1:
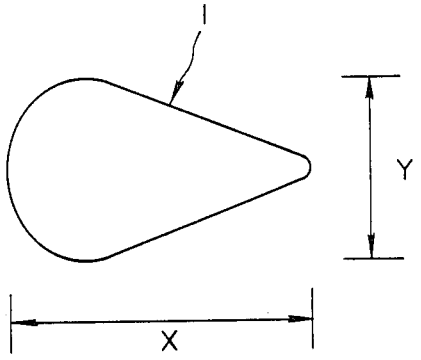
FIGS. 1 through 8 are plan views showing several examples of dimples which are non-circular in plane shape.

The petal shape may be a shape 1 obtained by starting from an equilateral triangle, rounding its apex, and bulging its bottom outward into a semi-circular shape as shown in FIG. 1.

Figure 2:
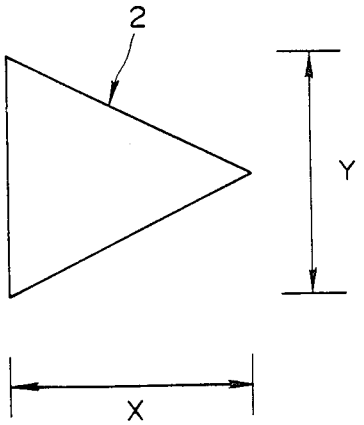

The triangular shape may be an equilateral triangle 2 as shown in FIG. 2 including a regular triangle as well as various triangles including right-angled triangles.

Figure 3:
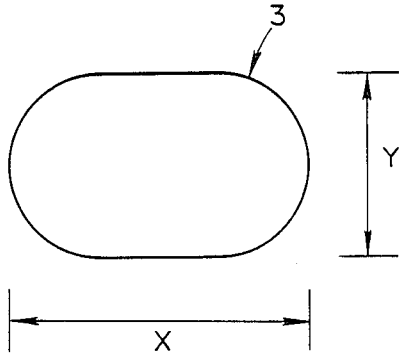
Figure 4:
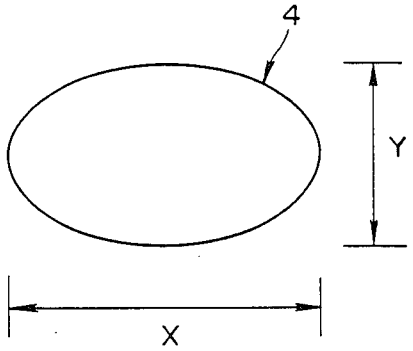

The oblong dimples include a racetrack-shaped dimple 3 as shown in FIG. 3 and an elliptical or oval dimple 4 as shown in FIG. 4.

Figure 5:
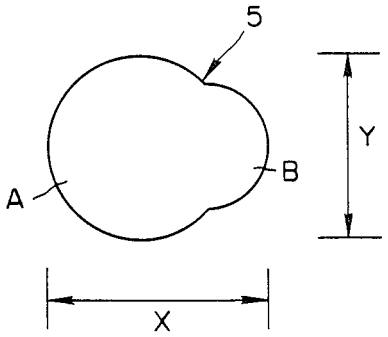
Figure 6:
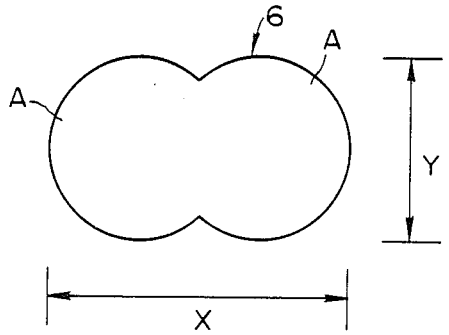
Figure 7:
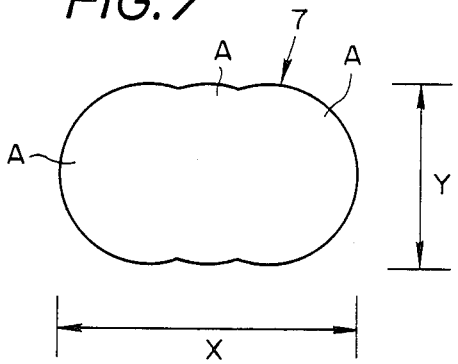
Figure 8:
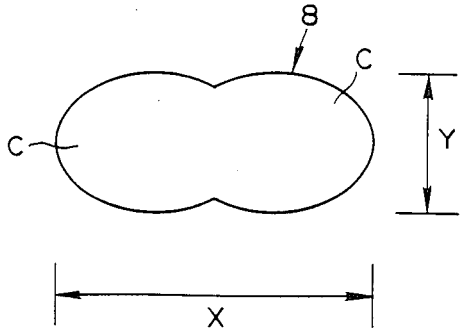

The dimples consisting of partially overlapped circles or oblongs include a snowman-like dimple 5 consisting of the outline of large and small circles A and B partially overlapped as shown in FIG. 5; a dimple 6 consisting of the outline of a pair of large circles A, A partially overlapped as shown in FIG. 6; a dimple 7 consisting of the outline of three large circles A, A, A juxtaposed in overlapping manner as shown in FIG. 7; and a dimple 8 consisting of the outline of a pair of ellipses C, C partially overlapped as shown in FIG. 8. Semi-circular, quarter-circular, and ⅛-circular dimples are also included in the non-circular dimples.

The non-circular dimples have a major axis designated at X and a minor axis designated at Y in FIGS. 1 through 8. The ratio in length of major axis X to minor axis Y preferably ranges from 2:1 to 1.05:1, more preferably from 1.8:1 to 1.3:1. The benefits of the present invention are sometimes lost with a ratio of less than 1.05:1. An arrangement of two circular dimples is sometimes advantageous rather than non-circular dimples having a ratio in excess of 2:1.

Figure 9:
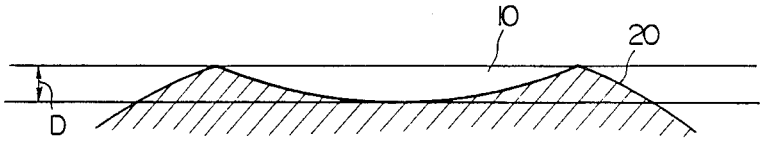
FIG. 9 is a schematic view of a dimple to illustrate its depth.

Referring now to FIG. 9, a dimple 10 is shown in cross section as having a depth D. Numeral 20 designates a land or flat portion. The non-circular dimple preferably has a depth D of at least 0.1 mm, more preferably in the range of from 0.15 mm to 0.4 mm. The benefits of the present invention are sometimes lost with a depth of less than 0.1 mm. Dimples of deeper than 0.4 mm will sometimes lose their aerodynamic properties.

The plane area of a non-circular dimple is preferably 1.05 to 2 times that of a circular dimple having a diameter equal to the minor axis Y of the non-circular dimple.

The golf ball of the present invention preferably contains 156 to 640 dimples in total. Provision of less than 156 dimples will sometimes fail to achieve satisfactory flying performance. When the number of dimples is more than 640, it is possible to uniformly distribute lands on the ball surface with only circular dimples.

In the practice of the present invention, the proportion in number of non-circular dimples is at least 7% based on the total number of dimples although all the dimples can be non-circular. Preferably, at least 10% of the dimples are non-circular while the remaining simples may be circular in plane shape. When non-circular dimples are located in admixture with circular dimples over a spherical surface of golf ball, the upper limit of the proportion in number of non-circular dimples may be 75% based on the total number of dimples. The location of non-circular dimples is not particularly limited although it is preferred to locate non-circular dimples where a wider land will otherwise be formed with only circular dimples.

In the golf ball design of the present invention, the dimples other than non-circular dimples are preferably formed as ordinary circular dimples. These circular dimples may be formed to a well-known size and depth, preferably to a diameter of 1.5 to 5 mm, especially 2 to 4 mm and a depth of at least 0.1 mm, especially 0.15 to 0.4 mm.

Since non-circular dimpes are distributed on the spherical surface of a golf ball in a proportion of at least 7% in number of the total dimples according to the present invention, the dimples can be uniformly and densely formed on the spherical surface so that the percent of the total area occupied by dimples on the spherical surface is increased. In the practice of the present invention, the percent of the total area occupied by dimples on the spherical surface, that is, the total of the areas of the dimples in plane shape (overall plane surface area of entire dimples) is at least 65%, preferably at least 73% of the surface area of a phantom sphere having the same diameter as the dimpled golf ball. With an increased percent of the total area occupied by dimples on the spherical surface and a correspondingly reduced land area, the dimples are more densely and uniformly distributed to ensure that the flying performance of the golf ball is improved and stabilized. The reduced land area also leads to a reduction in rigidity of that portion of a golf ball cover layer corresponding to the land to mitigate the shock to the golfers hand upon impact as previously mentioned. The upper limit of percent occupancy of dimples is preferably 95%.

The distribution pattern of dimples on the golf ball of the present invention is not particularly limited. A commonly known distribution pattern may be used. Examples of the patterns include regular tetrahedral (4-sided), hexahedral (6-sided), octahedral (8-sided), dodecahedral (12-sided), hexadecahedral (16-sided), and eicosahedral The dimple construction according to the present invention may be applied to any types of golf ball including small and large balls, thread wound balls, and two-piece balls.

Examples of the present invention are given below by way of illustration and not by way of limitation.

EXAMPLES

Figure 10:
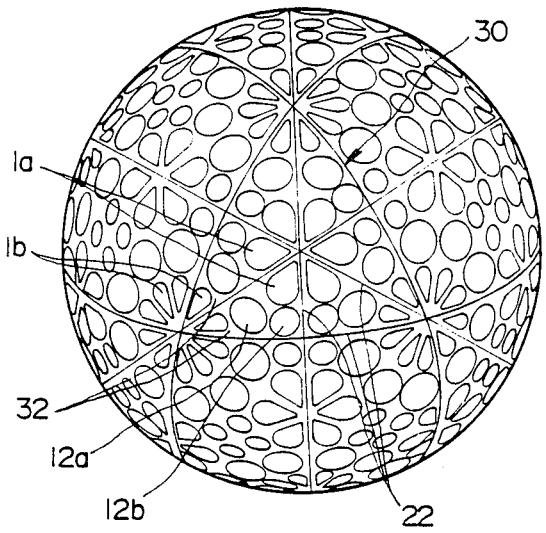
Figure 20:
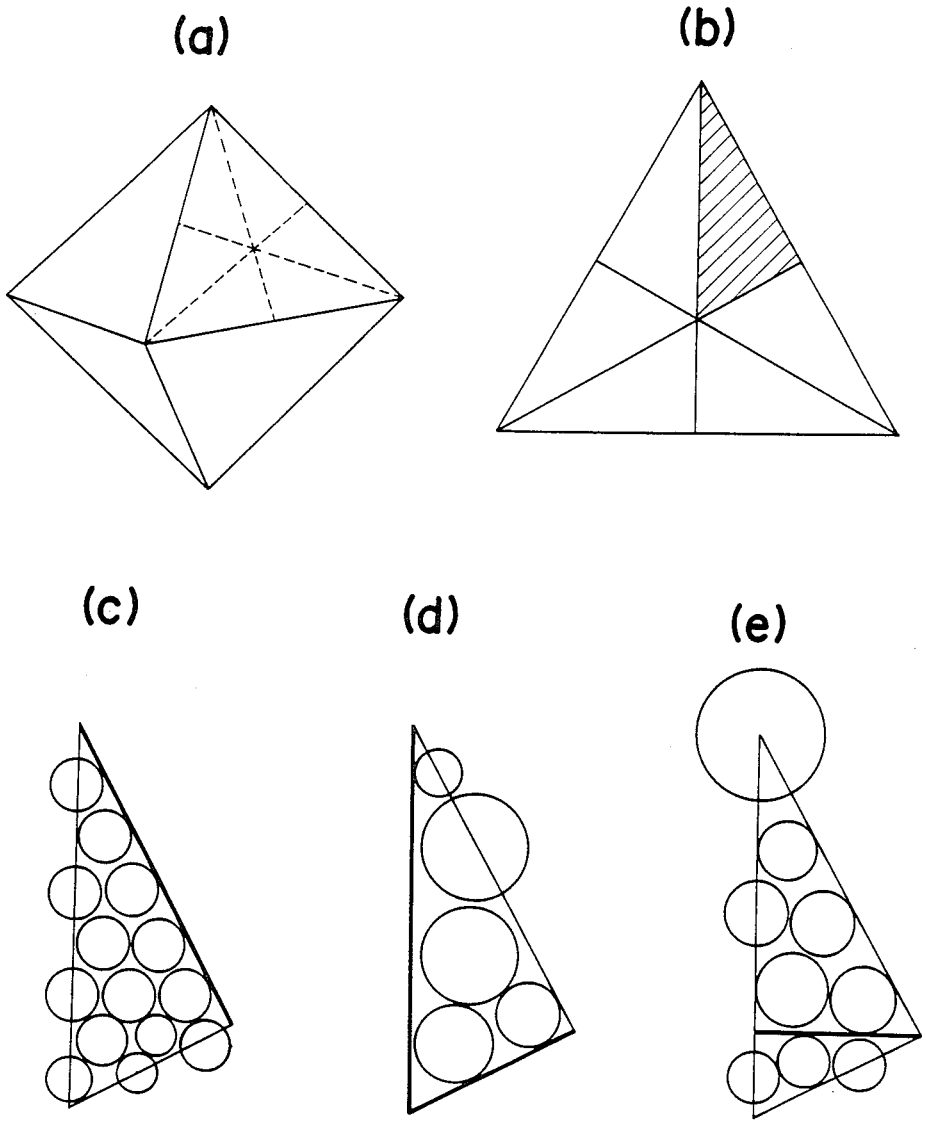
FIGS. 20(*a*)–(*e*) and 21(*a*)–(*e*) illustrate design concepts of dimple distribution according to the prior art.

One example preferred embodiment of a golf ball according to the present invention is shown in the elevational view of FIG. 10. The illustrated golf ball depends on a regular eicosahedron as its basic structure. The unit regular triangle shown in FIG. 20*b* is projected on the spherical surface as a spherical triangle 30, and the six standard units constituting the unit regular triangle projected thereon as spherical standard units 32.

In this example, annular lands 22 any of which can be a parting line are formed along the three sides of the spherical standard units 32. Each spherical standard unit 32 corresponds to the standard unit shown in FIG. 20*d*.

In each spherical standard unit 32, two large and small circular dimples 12*a* and 12*b* are located. One non-circular dimple 1*a* having a large petal shape is located in the acute angle between the two annular lands 22 intersecting at the center of the spherical triangle 30, and one non-circular dimple 1*b* having a small petal shape is located in the acute angle between the two annular lands 22 intersecting at one apex of the spherical triangle 30, both being very close to the annular lands 22. That is, each spherical standard unit 32 has four dimples in total, two circular and two non-circular. The proportion of the non-circular dimples is 50% in number of the total dimples.

With this dimple distribution pattern, two non-circular, petal-shaped dimples 1*a*, 1*b* are located in the spherical standard unit 32, particularly in proximity to two intersections of two annular lands 22. Dimples can be thus distributed in the spherical standard unit 32 with maximum density in an overall uniform fashion although three annular lands 22 extend within one spherical standard unit 32. As a result, the percent of total area occupied by dimples is increased to about 73% of the spherical surface area.

The illustrated example indicates that the flying performance of a golf ball is effectively increased and fully stabilized independent of the point of impact against the ball.

Figure 11:
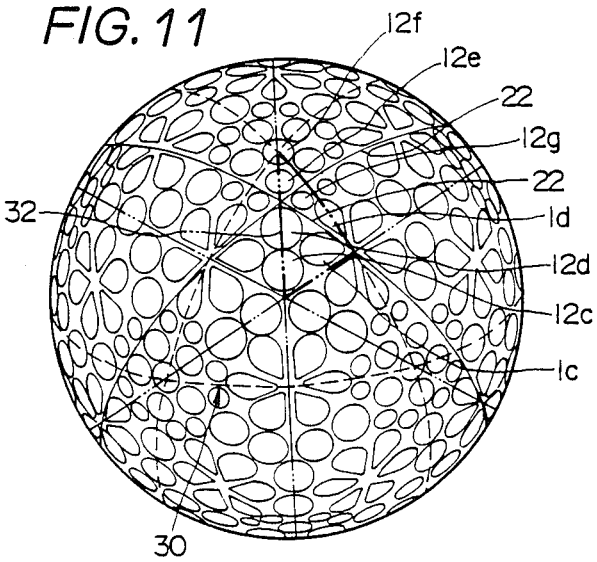
Figure 21:
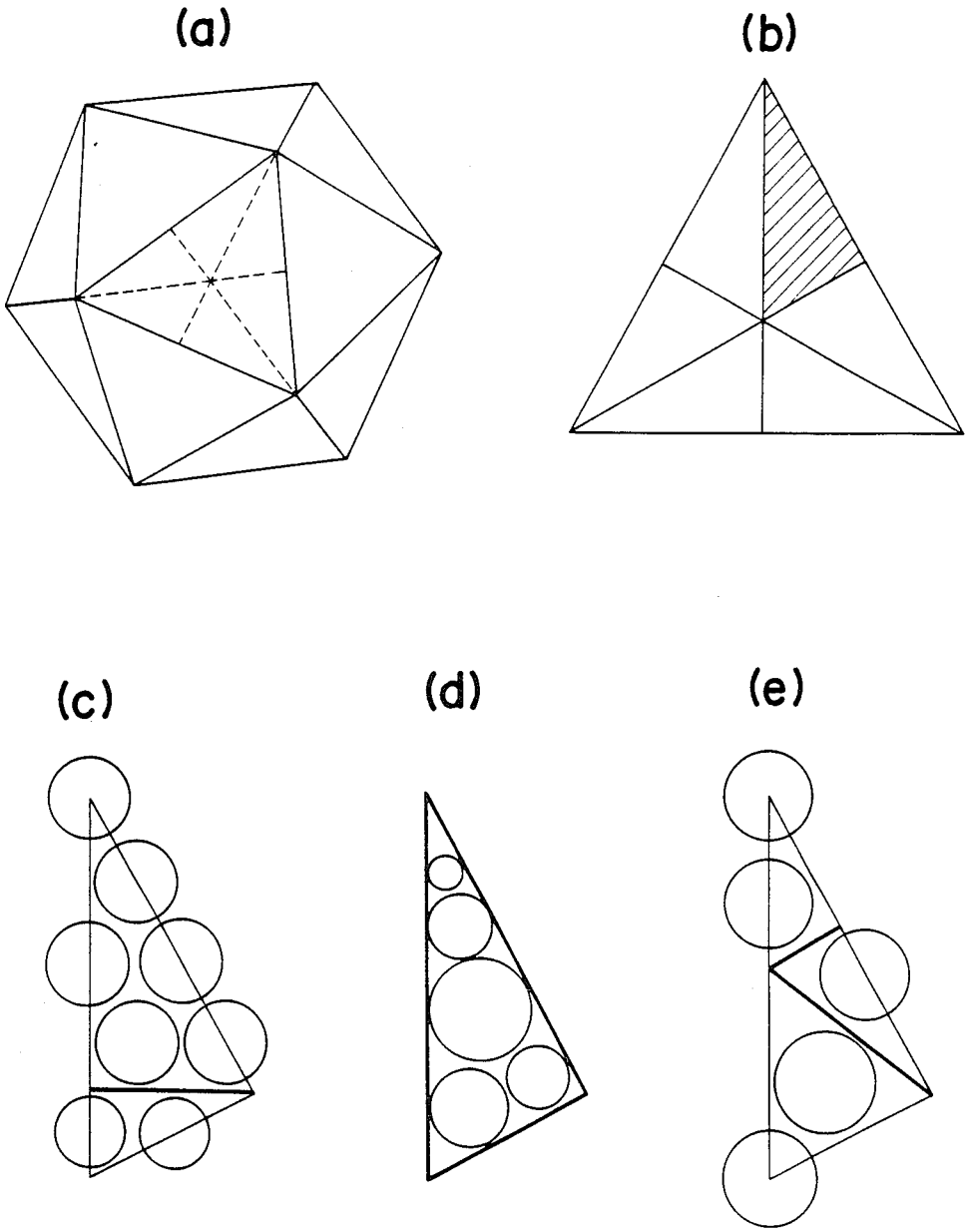

FIG. 11 is an elevational view showing another example a preferred embodiment a golf ball according to the present invention which also depends on a regular-/eicosahedron as its basic structure. Two annular lands 22 (solid lines) corresponding to the lands shown in FIG. 21*e* are formed in each of the spherical standard units 32 (thick dot-and-dash lines) constituting a spherical triangle 30 (broken lines) as in the previous example.

In each spherical standard unit 32, halves of two large circular dimples 12*c*, 12*d* are located along its longest side, a half of one small circular dimple 12*e* is located on that portion of the longest side extended near the apex of the spherical triangle 30 in nearly tangential contact with the side of an intermediate length of the spherical standard unit 32, and one by eight (1/8) of a circular dimple 12*f* is located on the apex of the included angle between the longest and intermediate sides. A non-circular dimple 1*c* having a petal shape is located in the included angle between the shortest side of the spherical standard unit 32 and one annular land 22, a half of another non-circular dimple 1*d* having a petal shape is located on the intermediate side and adjacent to the one annular land 22 in full proximity to the land, and a circular dimple 12*g* of the minimum diameter is located in the included angle between the annular lands 22. The proportion of the non-circular dimples is 36.6% in number of the total dimples.

With this dimple distribution pattern, inclusion of two non-circular dimples 1*c*, 1*d* enables dimples to be distributed in the spherical standard unit 32 with maximum density in an overall uniform fashion, and increases the percent of the total area occupied by dimples to about 75% of the spherical surface area. There are obtained benefits similar to those described in the previous example.

Figure 12:
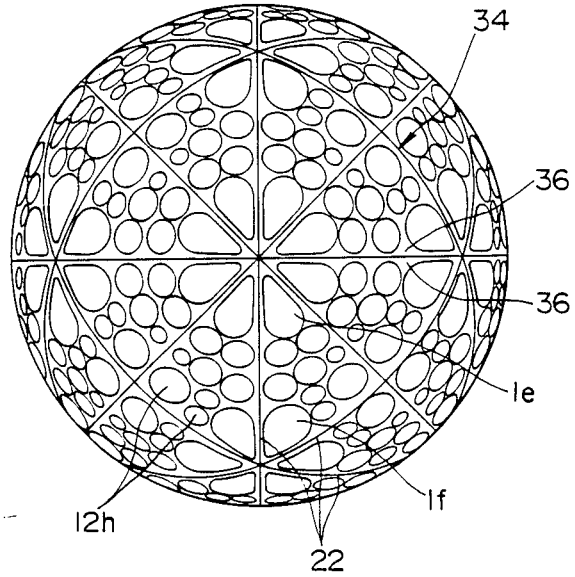
FIGS. 10 through 17 are plan views showing golf balls according to several embodiments of the present invention.

FIG. 12 illustrates a further preferred embodiment of the present invention. The dimple distribution pattern illustrated depends on a cube as a basic structure. The squares constituting the cube are projected on a spherical surface as spherical squares 34 and eight standard units constituting one square projected thereon as spherical standard units 36.

Annular lands 22 are formed along the three sides of each spherical standard unit 36. Eight large and small circular dimples 12*h* are located in the spherical standard unit 36. A non-circular dimple 1*e* having a small petal shape is located within the included angle between the longest and intermediate sides of the spherical standard unit 36, and another non-circular dimple 1*f* having a large petal shape located within the included angle between the intermediate and shortest sides, both being very close to the corresponding sides, that is, annular lands 22. The proportion of the non-circular dimples is 20% in number of the total dimples.

With this dimple distribution pattern, dimples can be distributed in the spherical standard unit 36 with maximum density in an overall uniform fashion, and the percent of the total area occupied by dimples is increased to about 77% of the spherical surface area. An improvement in flying performance and a further stabilization in flying performance of the golf ball are expected.

Figure 13:
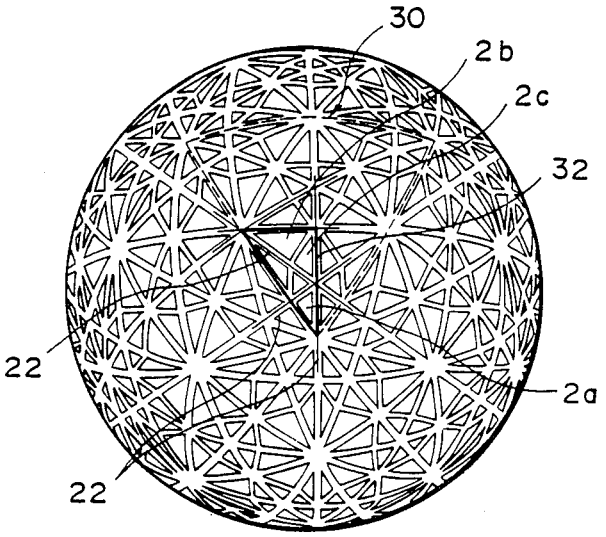
Figure 14:
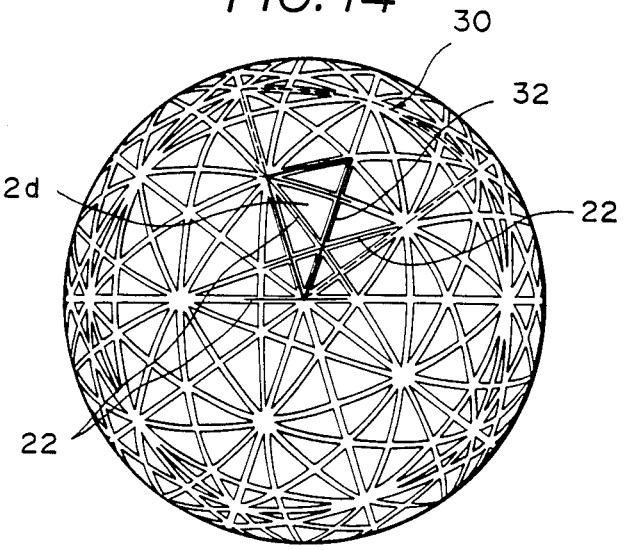

FIGS. 13 and 14 illustrate other preferred embodiments of the present invention in which the dimple distribution pattern depends on a regular eicosahedron as a basic structure. For either of the examples, in each of the spherical standard units 32 (thick solid lines) constituting a spherical triangle 30 (broken line), six in total annular lands 22 are formed including those annular lands extending along the sides of the unit.

Referring to the example shown in FIG. 13, in each triangular region encompassed by the annular lands 22, except one triangular dimple 2*a* located in the included angle between the longest and intermediate sides of the spherical standard unit 32, two large and two small triangular dimples 2*b* and 2*c* are located along the annular lands 22. The percent of the total area occupied by dimples is 80% of the spherical surface area.

The example of FIG. 14 shows that in each triangular region encompassed by the annular lands 22, one triangular dimple 2*d* is located in full proximity to each annular land 22. Then the percent of the total area occupied by dimples is 82% of the spherical surface area. In the golf balls of FIGS. 13 and 14, the proportion of non-circular dimples is 100% of the entire dimples.

It should be noted that best performance is expected when the triangular dimples shown in FIGS. 13 and 14, particularly in FIG. 14, have an area of occupation lower than the maximum permissible occupation area (about 19.6 $mm^2$) within which dimples can fully function.

Dimples are more densely and uniformly distributed in these examples than in the previous examples so that a further improvement is achieved in flying performance and flying performance stability. The rigidity of the overall lands including annular lands 22 is fully lowered to advantageously mitigate the shock upon impact.

Figure 15:
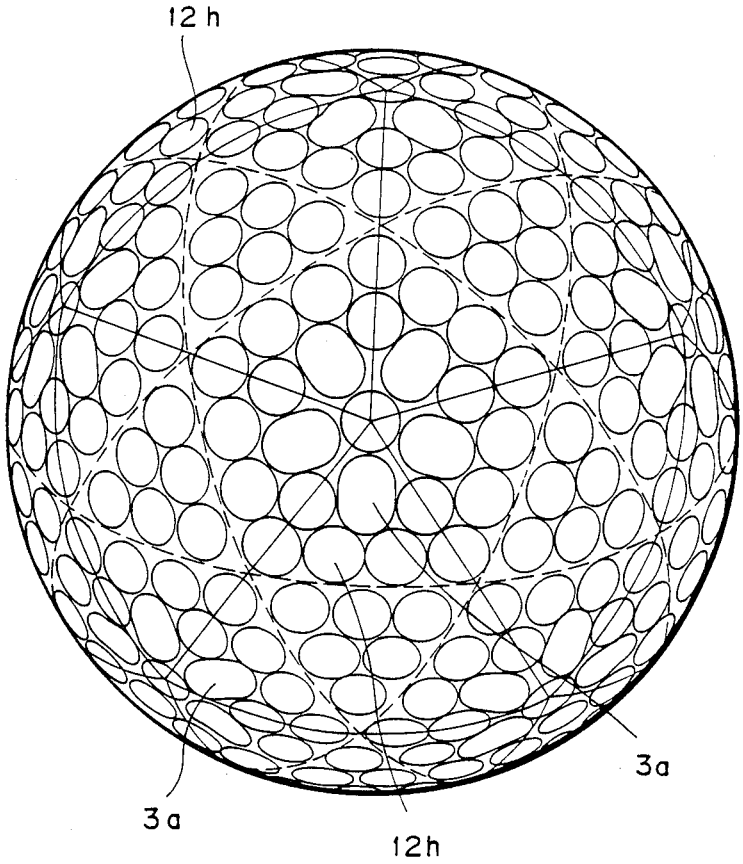
Figure 18:
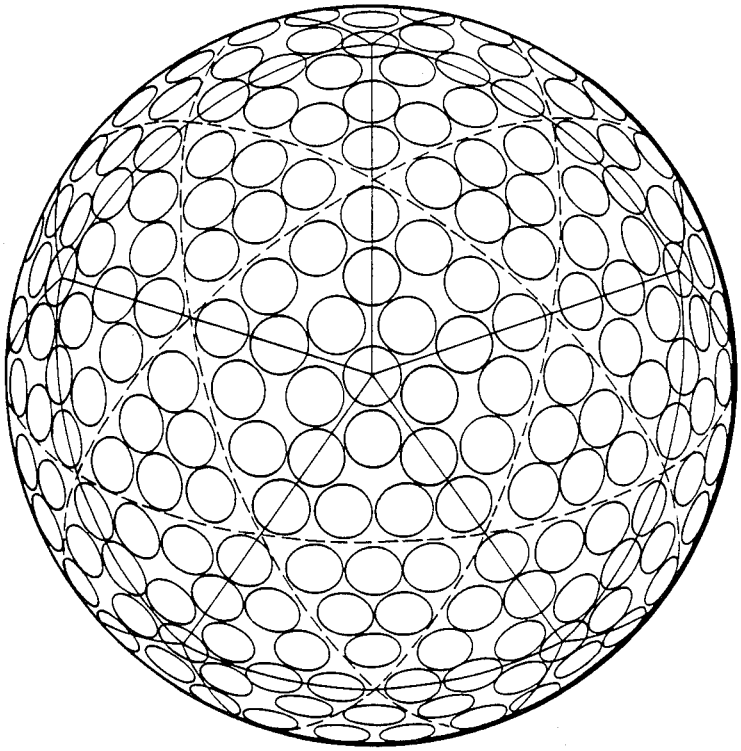
FIG. 18 (PRIOR ART)
FIGS. 18 and 19 are plan views showing prior art golf balls.

FIG. 15 illustrates a still further preferred embodiment of the golf ball design of the present invention. The ball has formed thereon circular dimples **12*h* and racetrack-shaped oblong dimples 3*a* as shown in FIG. 3. This ball is a modification of the ball shown in FIG. 18 which has an eicosahedral distribution pattern and contains circular dimples. A predetermined number of dimples among the circular dimples are replaced by oblong dimples, obtaining the ball of FIG. 15. In the ball of FIG. 15, the proportion of non-circular dimples to the entire dimples is 21%, and the percentage occupancy of the entire dimple is 76% of the spherical surface area. In the ball of FIG. 18** which is outside the present invention, the proportion of non-circular dimples is 0% and the percentage occupancy of the entire dimple is 70% of the spherical surface area.

Figure 16:
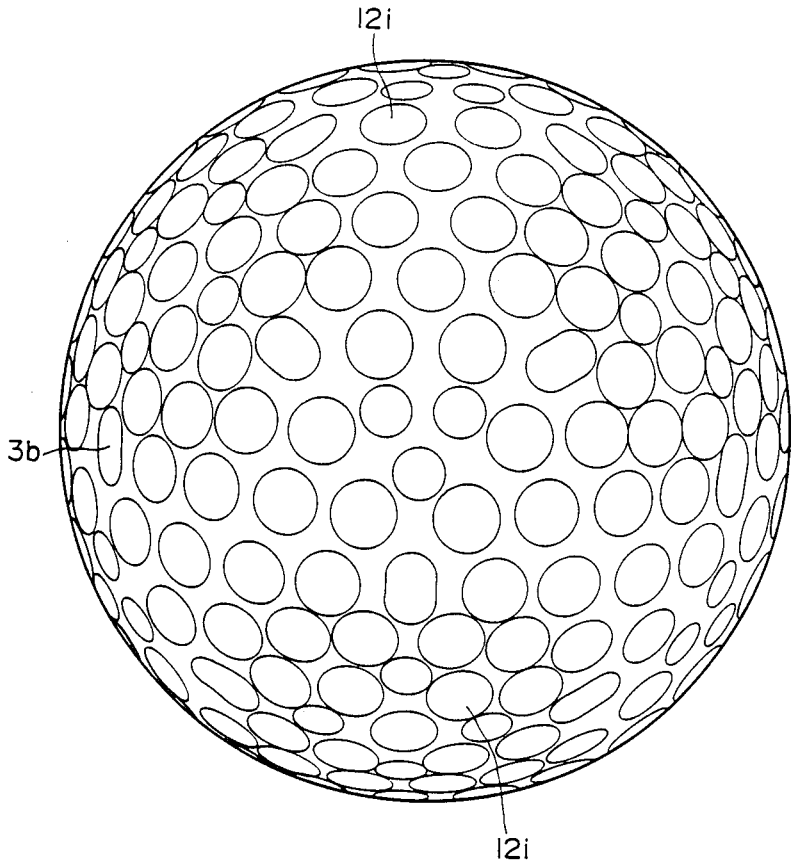
Figure 19:
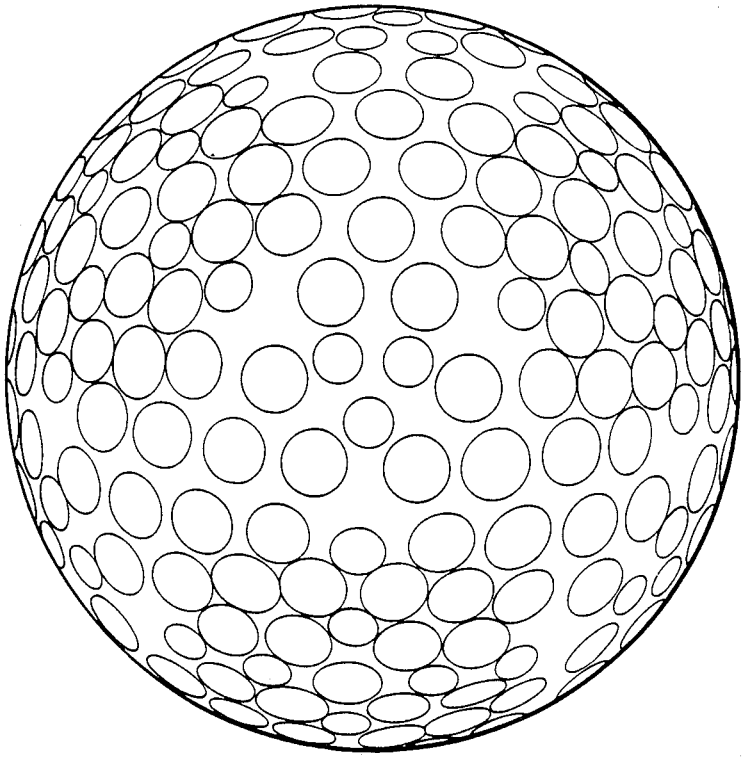
FIG. 19 (PRIOR ART)

FIG. 16 illustrates a yet further example. This golf ball also relies on a regular octahedral distribution and has formed thereon circular dimples **12*i* and racetrack-shaped oblong dimples 3*b* as shown in FIG. 3. A predetermined number of dimples among the circular dimples on the golf ball of FIG. 19 are replaced by oblong dimples, obtaining the ball of FIG. 16. In the ball of FIG. 16, the proportion of non-circular dimples to the entire dimples is 12%, and the percentage occupancy of the entire dimple is 65% of the spherical surface area. In the ball of FIG. 19** which is outside the present invention, the proportion of non-circular dimples is 0% and the percentage occupancy of the entire dimple is 62% of the spherical surface area.

Figure 17:
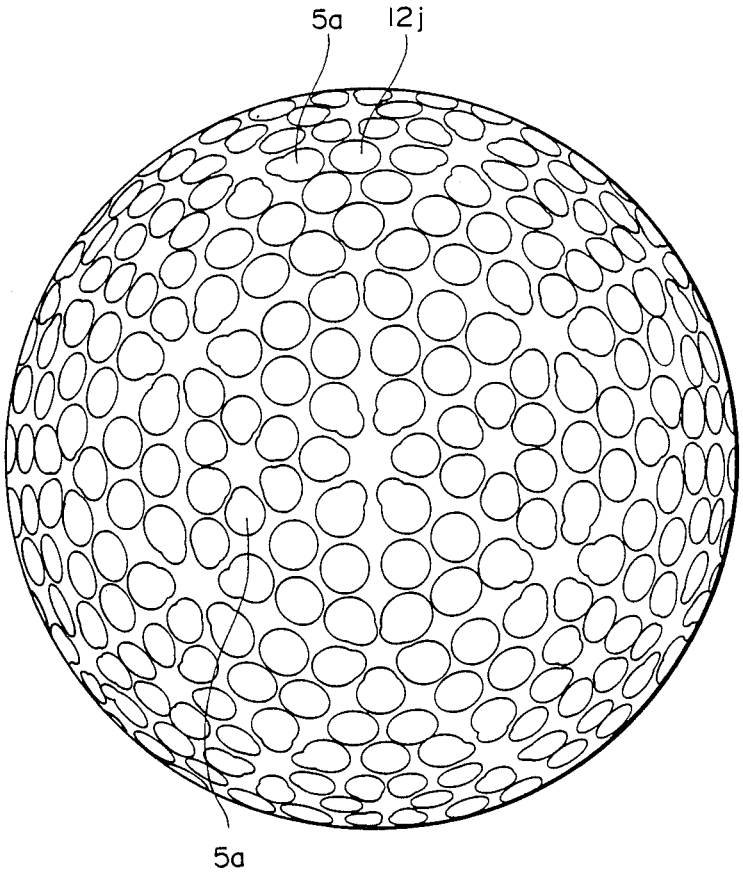

FIG. 17 illustrates a still further example. This golf ball relies on a regular eicosahedral distribution and has formed thereon circular dimples **12*j* and snowman-shaped dimples 5*a* consisting of overlapped large and small circles as shown in FIG. 5**. The proportion of non-circular dimples to the entire dimples is 23%, and the percentage occupancy of the entire dimple is 77% of the spherical surface area.

The golf balls of FIGS. 15 to 17 wherein a certain proportion of dimples are non-circular (oblong or overlapped circles or oblongs) have the advantage that dimples and hence, lands are uniformly distributed, as compared with the golf balls of FIGS. 18 and 19 wherein all the dimples are circular. More uniform distribution of dimples and lands will minimize the drawback of prior art golf balls that the quantity of spin imparted to a ball varies depending on the exact point of impact on the ball.

Although non-circular dimples of the same shape are formed on each of the balls shown in the previous embodiments, non-circular dimples of different shapes may be formed on a ball. Other modifications and variations may be made without departing from the scope of the present invention.

As understood from the foregoing description, the present invention enables dimples to be uniformly distributed on the spherical surface of a golf ball to thereby reduce the area of lands that will adversely affect the aerodynamic properties of the ball, accomplishing a substantial improvement in flying performance.

An increased proportion of the area that all dimples occupy on the spherical surface area allows dimples to be distributed quite uniformly and densely over the spherical surface, thus stabilizing the flying performance independent of the point of impact on the golf ball.

An increased percent of the total area occupied by dimples reduces the width of lands and hence, the percent area that lands occupy on the spherical surface, which in turn, reduces the rigidity of the lands, desirably mitigating the shock at the moment of impact.

Although the present invention has been fully described with reference to preferred embodiments, many modifications and variations thereof will now be apparent to those skilled in the art, and the scope of the present invention is therefore to be limited not by the details of the preferred embodiments described alone, but only by the terms of the appended claims.

We claim:

1. In a golf ball having a plurality of depressions formed in its spherical surface, wherein the improvement comprises:

said depressions including both circular and non-circular shaped depressions with respect to the plane of the spherical surface of the golf ball wherein said depressions occupy at least sixty-five percent (65) of the surface area of the spherical surface of said golf ball.

2. The improved golf ball is recited in claim 1 wherein:

at least seven percent (7%) of the total number of said plurality of depressions are non-circular in shape.

3. The improved golf ball is recited in claim 2 wherein said non-circular shaped depressions are petal shaped.

4. The improved golf ball as recited in claim 2 wherein said non-circular shaped depressions are oblong shaped.

5. The improved golf ball as recited in claim 2 wherein said no-circular shaped depressions are oval shaped.

6. The improved golf ball as recited in claim 2 wherein said non-circular shaped depressions are shaped from the outline of partially overlapping circular and other non-circular shapes.

* * * * *